US009250021B2

(12) United States Patent
Kim et al.

(10) Patent No.: US 9,250,021 B2
(45) Date of Patent: Feb. 2, 2016

(54) HEAT EXCHANGER

(75) Inventors: Young Mo Kim, Gyeonggi-do (KR); Young Sik Choi, Seoul (KR)

(73) Assignee: Kyungdong Navien Co., Ltd., Pyeongtaek-si, Gyeonggi-do (KR)

( * ) Notice: Subject to any disclaimer, the term of this patent is extended or adjusted under 35 U.S.C. 154(b) by 629 days.

(21) Appl. No.: 13/265,311

(22) PCT Filed: Apr. 20, 2010

(86) PCT No.: PCT/KR2010/002443
§ 371 (c)(1), (2), (4) Date: Oct. 31, 2011

(87) PCT Pub. No.: WO2010/123247
PCT Pub. Date: Oct. 28, 2010

(65) Prior Publication Data

US 2012/0037346 A1 Feb. 16, 2012

(30) Foreign Application Priority Data

Apr. 20, 2009 (KR) ..... 10-2009-0034253

(51) Int. Cl.
*F28D 1/053* (2006.01)
*F28D 7/16* (2006.01)
*F28D 9/00* (2006.01)
(Continued)

(52) U.S. Cl.
CPC ..... *F28D 7/1692* (2013.01); *F24H 1/38* (2013.01); *F28D 7/1623* (2013.01); *F28D 9/0081* (2013.01); *F28F 1/04* (2013.01); *F28F 1/06* (2013.01); *F28F 1/42* (2013.01); *F28F 1/426* (2013.01); *F28F 13/06* (2013.01); *F28D 1/05358* (2013.01); *F28D 1/05366* (2013.01)

(58) Field of Classification Search
CPC ..... F28D 1/05366; F28D 1/05358
USPC ..... 165/148, 150, 152
See application file for complete search history.

(56) References Cited

U.S. PATENT DOCUMENTS 1,313,077 A * 8/1919 Emmerman et al. ..... 165/148
1,413,163 A * 4/1922 Hromadko ..... 165/152
(Continued)

FOREIGN PATENT DOCUMENTS

CN 2809566 Y 8/2006
DE 100 34 568 A1 1/2002
(Continued)

OTHER PUBLICATIONS

English Language Abstract of WO 2008/117761 A1.
(Continued)

*Primary Examiner* — M. Alexandra Elve
*Assistant Examiner* — Joel Attey
(74) *Attorney, Agent, or Firm* — Novick, Kim & Lee, PLLC; Jae Youn Kim

(57) ABSTRACT

The device relates to a heat exchanger in which heat transfer between heating water passing through the inside of heat exchanging pipes and combustion gas is efficiently performed. The heat exchanger includes a plurality of heat exchanging pipes, through the inside of each of which heating water passes. The cross-section of each of the heat exchanging pipes has protrusions and recessions alternately arranged in the width direction of the heat exchanging pipe, so as to extend the flow path for the combustion gas passing between the heat exchanging pipes.

4 Claims, 8 Drawing Sheets

(51) Int. Cl.

| | |
|---|---|
| ***F24H 1/38*** | (2006.01) |
| ***F28F 1/04*** | (2006.01) |
| ***F28F 1/06*** | (2006.01) |
| ***F28F 1/42*** | (2006.01) |
| ***F28F 13/06*** | (2006.01) |

(56) References Cited

U.S. PATENT DOCUMENTS

| | | | | |
|---|---|---|---|---|
| 1,893,521 | A * | 1/1933 | Modine | 165/151 |
| 1,954,946 | A * | 4/1934 | Opitz | 165/148 |
| 2,424,587 | A * | 7/1947 | Smith et al. | 165/101 |
| 2,877,000 | A * | 3/1959 | Person | 165/159 |
| 3,757,856 | A * | 9/1973 | Kun | 165/166 |
| 4,901,791 | A * | 2/1990 | Kadle | 165/150 |
| 4,917,180 | A * | 4/1990 | Wolf et al. | 165/150 |
| 5,636,527 | A * | 6/1997 | Christensen et al. | 62/476 |
| 5,853,272 | A * | 12/1998 | Wartluft et al. | 408/199 |
| 6,047,769 | A * | 4/2000 | Shimoya et al. | 165/153 |
| 6,089,851 | A * | 7/2000 | Lupke et al. | 425/233 |
| 6,131,618 | A * | 10/2000 | Brudny et al. | 138/177 |
| 6,161,616 | A * | 12/2000 | Haussmann | 165/176 |
| 6,401,804 | B1 | 6/2002 | Shimoya | |
| 6,595,273 | B2 * | 7/2003 | Shimoya | 165/152 |
| 6,832,648 | B2 * | 12/2004 | Torigoe et al. | 165/148 |
| 6,920,918 | B2 * | 7/2005 | Knecht et al. | 165/157 |
| 7,009,146 | B2 * | 3/2006 | Torigoe | 219/206 |
| 7,156,162 | B2 * | 1/2007 | Manaka | 165/140 |
| 7,368,154 | B2 * | 5/2008 | Nishino et al. | 428/36.9 |
| 8,235,098 | B2 * | 8/2012 | Agee | 165/148 |
| 2002/0005279 | A1 * | 1/2002 | Maute | 165/148 |
| 2003/0196785 | A1 * | 10/2003 | Knecht et al. | 165/148 |
| 2004/0069472 | A1 * | 4/2004 | Shimoya | 165/165 |
| 2004/0079521 | A1 | 4/2004 | Torigoe | |
| 2004/0194933 | A1 * | 10/2004 | Ikeda | 165/144 |
| 2004/0238162 | A1 * | 12/2004 | Seiler et al. | 165/148 |
| 2005/0274504 | A1 * | 12/2005 | Torigoe | 165/153 |
| 2006/0249557 | A1 * | 11/2006 | Bortoli | 228/49.3 |
| 2007/0227715 | A1 * | 10/2007 | Shimoya et al. | 165/152 |
| 2007/0289728 | A1 * | 12/2007 | Itoh et al. | 165/177 |
| 2008/0000627 | A1 * | 1/2008 | Noguchi et al. | 165/173 |
| 2008/0061160 | A1 | 3/2008 | Ootomo et al. | |
| 2008/0087408 | A1 * | 4/2008 | Maezawa et al. | 165/151 |
| 2009/0113711 | A1 * | 5/2009 | Tsuji et al. | 29/890.03 |
| 2009/0266510 | A1 * | 10/2009 | Reynolds | 165/47 |
| 2010/0116474 | A1 * | 5/2010 | Kerler et al. | 165/148 |

FOREIGN PATENT DOCUMENTS

| | | | |
|---|---|---|---|
| DE | 103 45 695 | A1 | 4/2004 |
| EP | 1 172 626 | A2 | 1/2002 |
| JP | S50-153575 | | 12/1975 |
| JP | S62-34659 | | 2/1987 |
| JP | H04-115268 | | 10/1992 |
| JP | 2004-92942 | A | 3/2004 |
| JP | 2005-001448 | A | 1/2005 |
| JP | 2005-300135 | A | 10/2005 |
| JP | 2007-147173 | A | 6/2007 |
| KR | 10-1996-003470 | B | 3/1996 |
| KR | 10-0228032 | B | 11/1999 |
| KR | 10-0345156 | B | 7/2002 |
| KR | 10-0353761 | B | 9/2002 |
| KR | 10-0440672 | B | 7/2004 |
| KR | 10-0833482 | B | 5/2008 |
| WO | WO 2008/117761 | A1 | 10/2008 |

OTHER PUBLICATIONS

English Language Abstract of JP 2007-147173 A.
English language Abstract for JP 2005-300135 A.
Canadian Office Action issued in a counterpart foreign patent application on Jul. 15, 2013.
English Language Abstract of JP 2004-92942 A.
English language translation of the Japanese Office Action mailed on Feb. 26, 2013.
English Abstract of JP 2005-001448 A.
English Abstract of KR 10-0345156 B.
English Abstract of KR 10-0833482 B.
English Abstract of KR 10-0228032 B.
English Abstract of KR 10-1996-0003470 B.
English Abstract of KR 10-0353761 B.
English Abstract of KR 10-0440672 B.
International Search Report mailed Dec. 21, 2010.
European Search Report for European Patent Application No. 10767261 mailed on Apr. 2, 2014.

* cited by examiner

HEAT EXCHANGER

TECHNICAL FIELD

The present invention relates to a heat exchanger that is used for a boiler, and more particularly, to a heat exchanger that allows efficient heat transfer between a combustion gas and a heating water flowing through heat exchanging pipes.

BACKGROUND ART

As known in the art, examples of a combustor that can heat heating water flowing through the inside of a heat exchanging pipe in a combustion chamber by using a burner may include a boiler and a water heater and etc. That is, the boiler that is used in a general home, a public building, or the like is used for heating a room and supplying a hot water and the water heater heats cold water up to a predetermined temperature within a short time to allow a user to conveniently use the hot water. Most of the combustors such as the boiler and the water heater are constituted by a system that uses oil or gas as fuel and combusts the oil or gas by means of a burner, heat water by using combustion heat generated in the course of the combustion, and supplies the heated water (hot water) to a user.

The combustors are equipped with a heat exchanger that absorbs combustion heat generated from the burner and various methods for improving heat transfer efficiency of the heat exchanger have been proposed.

In the related art, a method of increasing the heat transfer area of a heat exchanging pipe by forming a plurality of fins on the outer surface of a heat exchanging pipe has been generally used. However, the manufacturing method of the heat exchanging pipe is complicated and the manufacturing cost increases, while the effect of heat transfer area by the fins is not substantially increased.

FIG. 1 is a view showing a rectangular heat exchanger of which the manufacturing method is simpler than that of a fin type heat exchanger of the related art.

The heat exchanger has a configuration in which both ends of heat exchanging pipes 1 having a rectangular cross-section with the width larger than the height are fitted in fixing plates 2 and 3, and end plates 4 and 5 are fixed to the fixing plate, for example, by brazing, i.e., braze-welding. A heating water inlet 6 and a heating water outlet 7 are formed at the end plates 4 and 5, respectively. The heat exchanging pipes 1 are connected by pipe connectors 8, respectively, such that heat water flowing through the heat water inlet 6 is discharged through the heating water outlet 7 after passing through the heat exchanging pipes 1 and the pipe connectors 8. The heat exchanger has the advantage in that the manufacturing method is simpler than that of a fin type heat exchanger and the heat transfer area can be sufficiently ensured.

However, a combustion gas due to combustion in a burner of the heat exchanger flows through the spaces between the heat exchanging pipes 1 in the direction of an arrow, but the flow path of the combustion gas is relatively short, such that the heat of the combustion gas is not sufficiently transferred to the heat exchanging pipes 1. Further, since the gaps between the heat exchanging pipes 1 are usually 1 to 2 mm in home boilers, as the boiler is operated and the heating water flows into the heat exchanging pipes 1, the heat exchanging pipes 1 are expanded by pressure of the heating water and block the flow path of the combustion gas, such that the heat exchange efficiency is reduced.

DISCLOSURE

Technical Problem

The present invention has been made in an effort to provide a heat exchanger that can increase heat transfer efficiency by increasing the length of the path of a combustion gas passing heat exchanging pipes and allowing the combustion gas to generate a turbulent flow. Further, the present invention has been made in an effort to provide a heat exchanger that can prevent heat exchanging pipes from blocking paths of a combustion gas by expanding due to pressure of heating water flowing through the heat exchanging pipes. In addition, the present invention has been made in an effort to provide a heat exchanger that can keep uniform gaps between heat exchanging pipes through which a combustion gas passes.

A heat exchanger according to an exemplary embodiment of the present invention includes: a plurality of heat exchanging pipes, each of which has an end with an open flat tube-type cross-sectional surface, and through the inside of each of which heating water passes; a first fixing plate and a second fixing plate, each of which has pipe insertion holes formed at a predetermined spacing in the lengthwise direction of the plate, such that both ends of the plurality of heat exchanging pipes are inserted into the respective pipe insertion holes; a first parallel flow channel cap and a second parallel flow channel cap fixed at the respective first fixing plate and second fixing plate to close both ends of the heat exchanging pipes and thus form a parallel flow channel; a heating water inlet connected to the first parallel flow channel cap; and a heating water outlet connected to either the first or second parallel flow channel caps, in which the cross-section of each of the heat exchanging pipes has protrusions and recessions alternately arranged in the width direction of the heat exchanging pipe, so as to extend the flow path of the combustion gas passing through between the heat exchanging pipes.

The heat exchanging pipes have a plurality of protrusions that are spaced in the length direction of the heat exchange pipes and protrude in the width direction of the heat exchange pipes and the protrusions of adjacent heat exchanging pipes are in contact with each other.

The cross-sections of the upper portion and the lower portion of the heat exchanging pipe in the thickness direction have shapes matching with each other and the cross-sectional shapes of the flow path of the combustion gas which are formed by adjacent heat exchanging pipes are similar.

The first parallel flow channel cap and the second parallel flow channel cap are formed by pressing and have a plurality of dome-shaped portions for closing the ends of the heat exchanging pipes and connecting portions between the dome-shaped portions, and insertion plates having a shape similar to the cross-sectional shape of the heat exchanging pipes are inserted between the heat exchanging pipes at the connecting portions such that the shape and the gap of the flow path of the combustion gas is similarly maintained.

The heat exchanging pipes are formed by pressing and bent, and then the connecting portions are welded.

Advantageous Effects

According to the heat exchanger of the present invention, it is possible to increase heat transfer efficiency by extending the flow path of the combustion gas flowing through the heat exchanging pipes. Further, it is possible to prevent heat exchange pipes from blocking paths of a combustion gas by expanding due to pressure of heating water flowing through the heat exchange pipes. In addition, it is possible to keep the entire gaps between the heat exchanging pipes through which the combustion gas flows uniform.

EXPLANATION OF MAIN REFERENCE NUMERALS AND SYMBOLS

Figure 1:
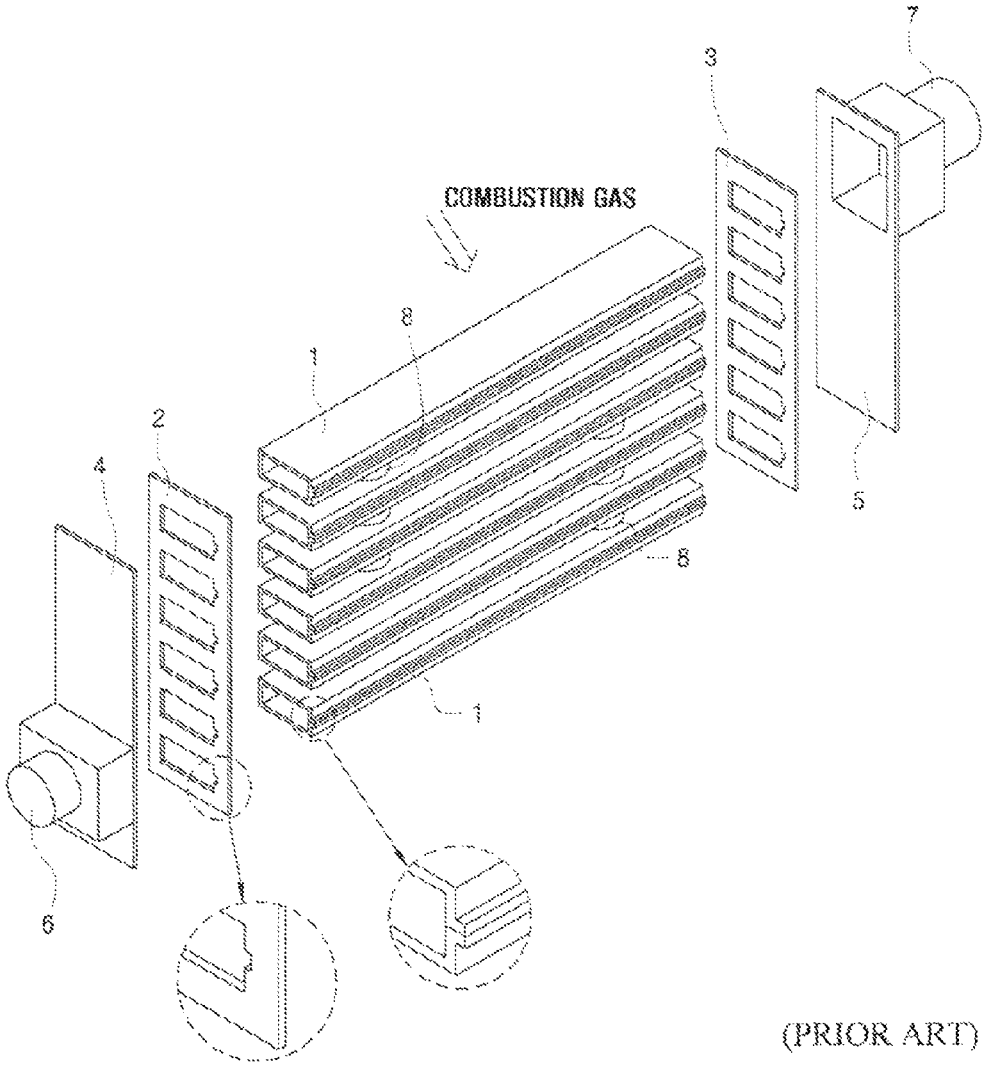
(PRIOR ART) FIG. 1
FIG. 1 is prior art, and is a view showing a rectangular heat exchanger of the related art.

10: Heat exchanging pipe
11: First Protrusion
12: Recession
13: Second Protrusion
21: First fixing plate
21*a*: Pipe insertion hole
22: Second fixing plate
31: First parallel flow channel cap
32: Second parallel flow channel cap
31*a*, 32*a*: Dome-shaped portion
31*b*, 32*b*: Connecting portion
41: Heating water inlet
42: Heating water outlet
50: Insertion plate

Best Mode

Hereinafter, the configuration and operation of preferred embodiments of the present invention will be described in detail with reference to the accompanying drawings. Giving reference numerals to components in the drawings herein, it is noted that the same components are designated by substantially the same reference numerals, even though they are shown in different drawings.

Figure 2:
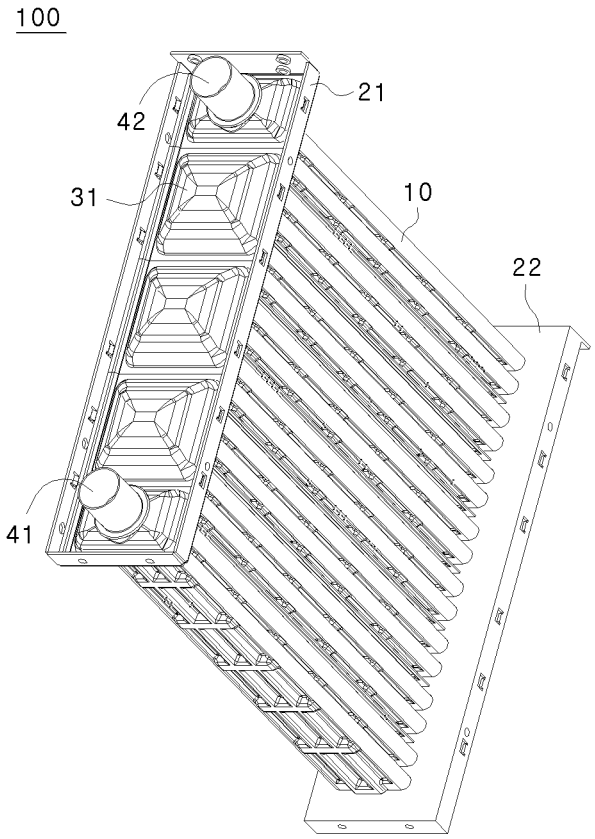
FIG. 2 is a perspective view of a heat exchanger according to an exemplary embodiment of the present invention.
Figure 3:
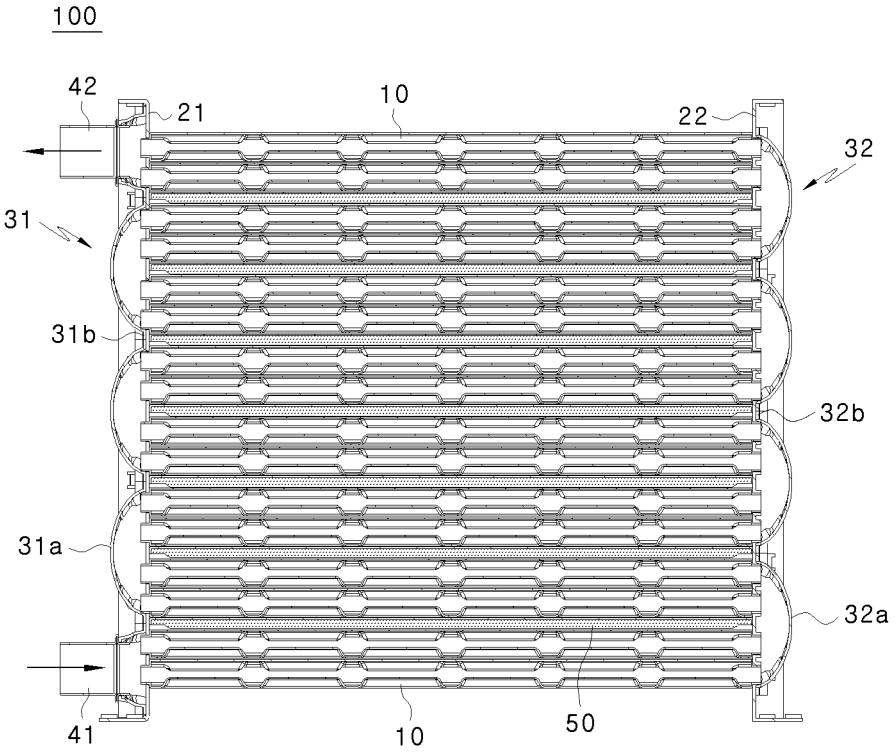
FIG. 3 is a view showing a schematic cross-section of the heat exchanger according to an exemplary embodiment of the present invention.

FIG. 2 is a perspective view of a heat exchanger 100 according to an exemplary embodiment of the present invention and FIG. 3 is a view showing a schematic cross-section of the heat exchanger.

The heat exchanger 100 includes heat exchanging pipes 10, a first fixing plate 21, a second fixing plate 22, a first parallel flow channel cap 31, a second parallel flow channel cap 32, a heating water inlet 41, and a heating water outlet 42.

The heat exchanging pipe 10 has a flat tube-shaped cross-section with its ends being open and heat water flows through the heat exchanging pipe 10. The heat exchanging pipes 10 are longitudinally stacked.

Figure 6:
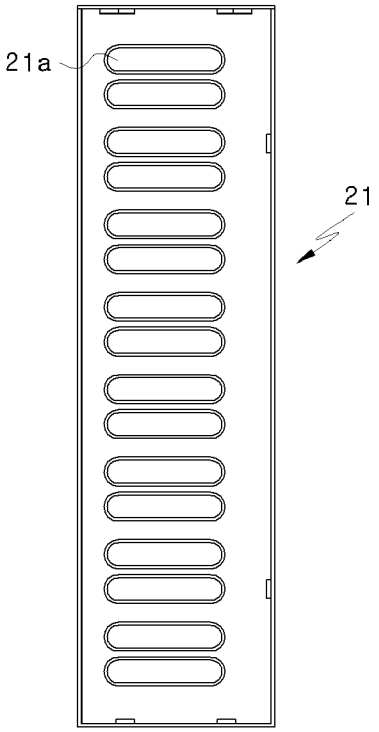
FIG. 6 is a view showing the shape of a first fixing plate according to an exemplary embodiment of the present invention.

The first fixing plate 21 and the second fixing plate 22 have pipe insertion holes 21*a* longitudinally disposed at regular intervals and both ends of the heat exchanging pipes 10 are inserted in the pipe insertion holes (see FIG. 6).

The first parallel flow channel cap 31 and the second parallel flow channel cap 32 are fixed to the first fixing plate 21 and the second fixing plate 22, respectively, and form parallel flow channels by closing both open ends of the heat exchanging pipes 10.

The lower portion of the first parallel flow channel cap 31 is connected with the heating water inlet 41 and the upper portion is connected with the heating water outlet 42. Unlikely, the heating water inlet 41 may be connected with the lower portion of the first parallel flow channel cap 31 and the heating water outlet 42 may be connected with the upper portion of the second parallel flow channel cap 32.

The flow path of heating water that flows through the heat exchanger 100 is described hereafter with reference to FIG. 3.

Heating water flows inside through the heating water inlet 41 at the lower portion of the heat exchanger 100 and flows to the right side after passing through two heat exchanging pipes 10. The heating water passing through the right end of the heat exchanging pipe 10 flows to the left side through the right ends of another two heat exchanging pipes 10 stacked on the above two heat exchanging pipes 10. The right ends of the four heat exchanging pipes 10 are closed by a dome-shaped portion 32*a* of the second parallel flow channel cap 32.

The heating water flowing to the left side flows to the right side along another two heat exchanging pipes 10 after passing through a dome-shaped portion 31*a* of the first parallel flow channel cap 31. The heating water is discharged through the heating water outlet 42 connected with the upper portion of the first parallel flow channel cap 31 after passing through the heat exchanging pipes 10 while changing the flow path in zigzag in this way. The heating water exchanges heat with a combustion gas generated by combustion in a burner while flowing through the heat exchanging pipes 10. In the figure, the combustion gas transfers heat to the heating water while passing through between the heat exchanging pipes 10 in the direction perpendicularly facing the drawing or its opposite direction.

Figure 4:
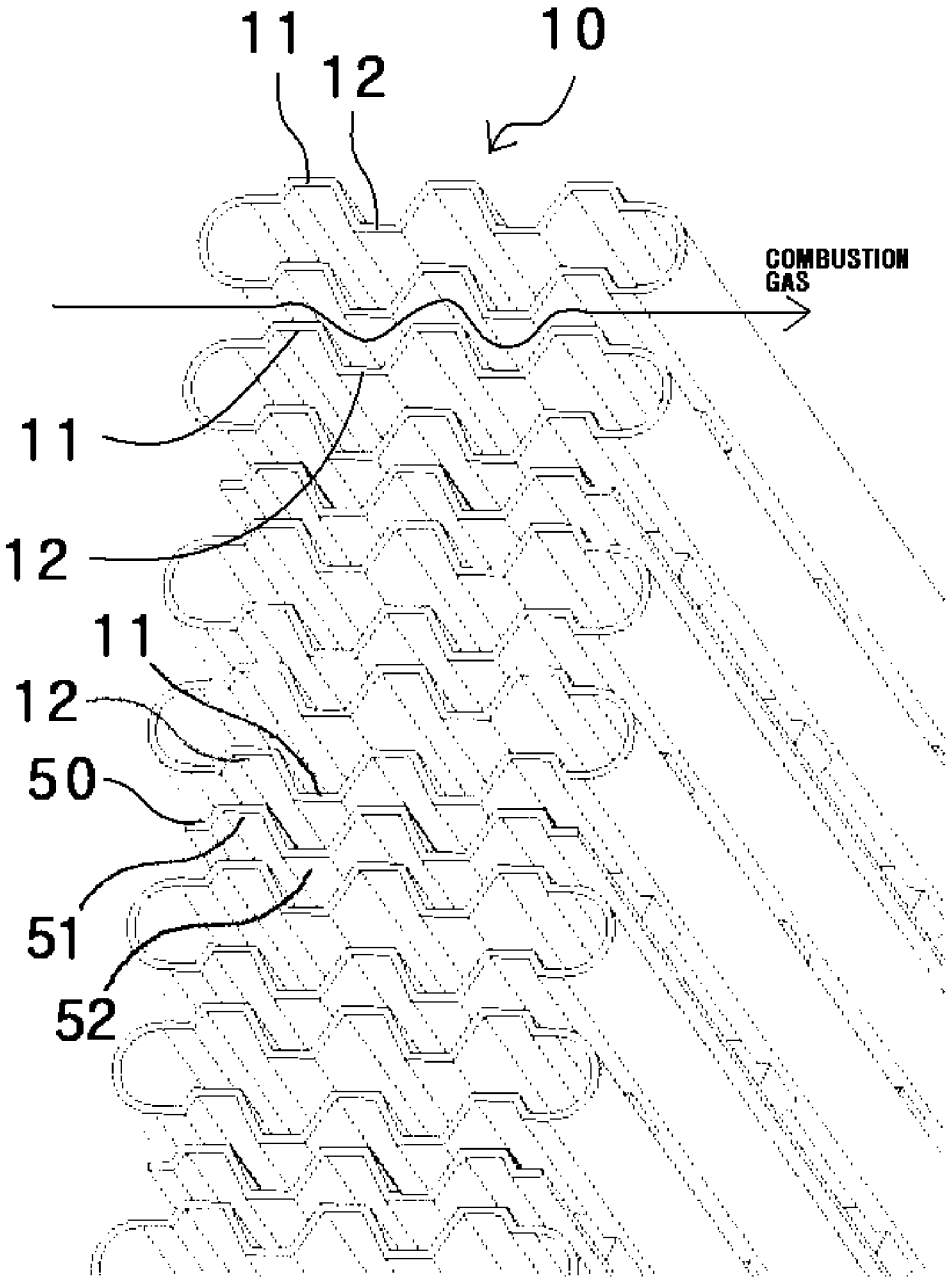
FIG. 4 is a view showing a cross-section when a plurality of heat exchanging pipes according to an exemplary embodiment of the present invention is stacked.
Figure 5:
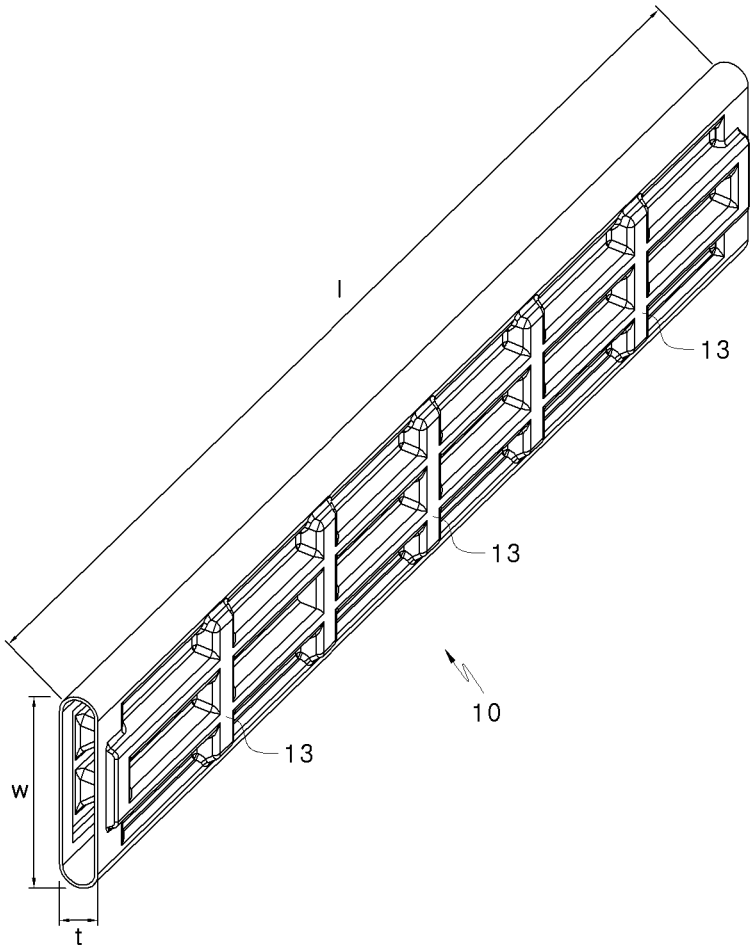
FIG. 5 is a view showing the shape of the heat exchanging pipe according to an exemplary embodiment of the present invention.

FIG. 4 is a view showing a cross-section when the heat exchanging pipes 10 are stacked and FIG. 5 is a view showing the shape of one of the heat exchanging pipes 10.

In the exemplary embodiment, the width direction w of the heat exchanging pipe 10 is the direction in which the combustion gas passes through between the heat exchanging pipes, the thickness direction t is the direction showing the thickness of the heat exchanging pipe 10 having the flat tube-shaped cross-section, and the longitudinal direction l is the direction showing the entire length of the heat exchanging pipe 10 (see FIG. 5).

The cross-section of the heat exchanging pipe 10 has a shape with first protrusions 11 and recessions 12 alternately arranged in the width direction w of the heat exchanging pipe 10 to extend the flow path of the combustion gas passing through between the heat exchanging pipes. Further, the cross-section of the heat exchanging pipe 10 has a shape with the upper portion and the lower portion matching with each other in the thickness direction t. That is, when the upper portion protrudes in the thickness direction t, the lower portion is recessed in the heat exchanging pipe 10. Therefore, the cross-sectional shape of the flow path for the combustion gas, which is formed by two adjacent heat exchanging pipes 10, is a plurality of S-shapes and these shapes are substantially the same throughout the heat exchanging pipes 10.

According to this configuration, the flow path of the combustion gas extends and the heat transfer area of the heat exchanging pipes 10 increases, such that the heat of the combustion gas can be sufficiently transferred to the heat water in the heat exchanging pipes 10. Further, since the flow path of the combustion gas is formed in an S-shape, the combustion gas generates a turbulent flow. Therefore, the combustion gas stays longer in the flow path and the heat of the combustion gas can be correspondingly transferred well to the heating water through the heat exchanging pipes 10, such that heat exchange efficiency can be increased.

It is preferable to manufacture the heat exchanging pipe 10 by pressing a metal sheet for the shapes of the upper portion and the lower portion in the thickness direction t, bending the middle portion, and then welding the connecting portions. The manufacturing cost of the heat exchanging pipe 10 is reduced by simplifying the manufacturing process. Meanwhile, as the boiler is operated and the heating water flows into the heat exchanging pipe 10, the heat exchanging pipe 10 may extend in the thickness direction to due to pressure of the heating water. In general, the heat exchanger disposed in a home boiler is small in size and the gaps between the heat exchanging pipes 10 are about 1 to 2 mm. That is, the combustion gas flows through a gap of about 1 to 2 mm, such that the heat exchanging pipe 10 blocks the path of the combustion gas when expanding, thereby reducing the heat exchange efficiency.

Since the heat exchanging pipe 10 has the first protrusions 11 and the recessions 12 that are alternately arranged and is manufactured by pressing, the rigidity is sufficient and the expansion of the heat exchanging pipe 10 due to the pressure of the heating water is very small. However, it is preferable that the heat exchanging pipes have a plurality of second protrusions 13, which protrudes to both sides in the width direction of the heat exchanging pipe at a predetermined distance in the longitudinal direction of the heat exchanging pipe, in order to more securely prevent the expansion of the heat exchanging pipe 10 due to the pressure of the heating water. The second protrusions 13 of adjacent heat exchanging pipes are in contact with each other when the heat exchanging pipes 10 are arranged in the longitudinal direction. Therefore, the flow path of the combustion gas can be prevented from being blocked by the expanding heat exchanging pipes 10, by the second protrusions 13.

Meanwhile, the protrusions 13 are spaced in the longitudinal direction of the heat exchanging pipe 10. That is, the protrusions 13 are spaced in parallel with the flow path of the combustion gas, such that the flow path of the combustion gas is not substantially blocked by the protrusions 13, while the flow path of the combustion gas is divided into several section, such that the heat of the combustion gas can be transferred well to the heat exchanging pipes 10. Further, the heating water flowing through the heat exchanging pipes 10 generates a turbulent flow while passing the protrusions 13, such that the heating water can further receive the heat of the combustion gas and the entire heat exchange efficiency is increased.

FIG. 6 is a view showing the shape of the first fixing plate 21 according to an exemplary embodiment of the present invention. The second fixing plate 22 is the same in shape as the first fixing plate 21.

The pipe insertion holes 21*a* where the ends of the heat exchanging pipes 10 are inserted are formed at regular intervals at the first fixing plate 21. The first parallel flow channel cap 31 is fixed, for example, by brazing above the first fixing plate 21 to form a parallel flow channel.

Figure 7A:
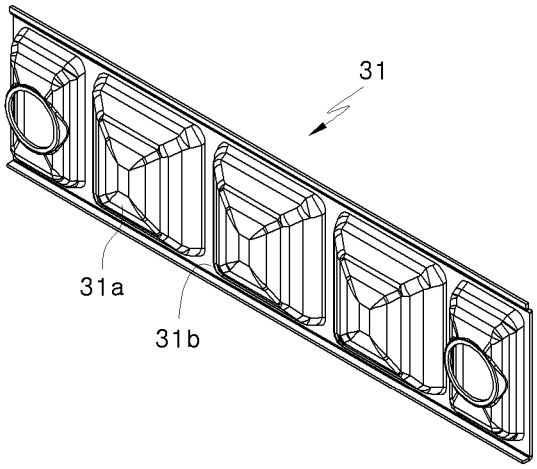
FIG. 7A and 7B are views showing the shape of a first parallel flow channel cap according to an exemplary embodiment of the present invention.
Figure 7B:
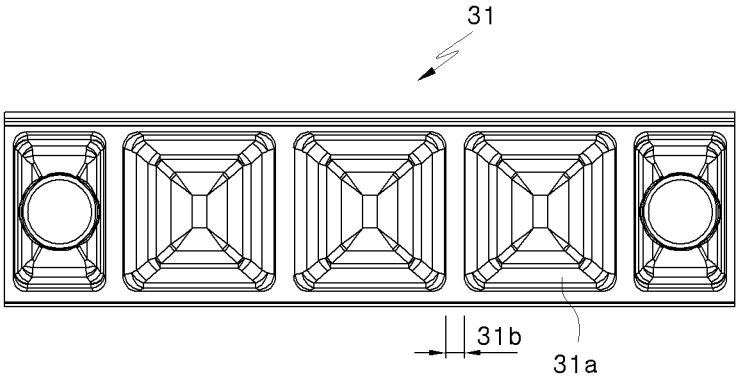
Figure 8:
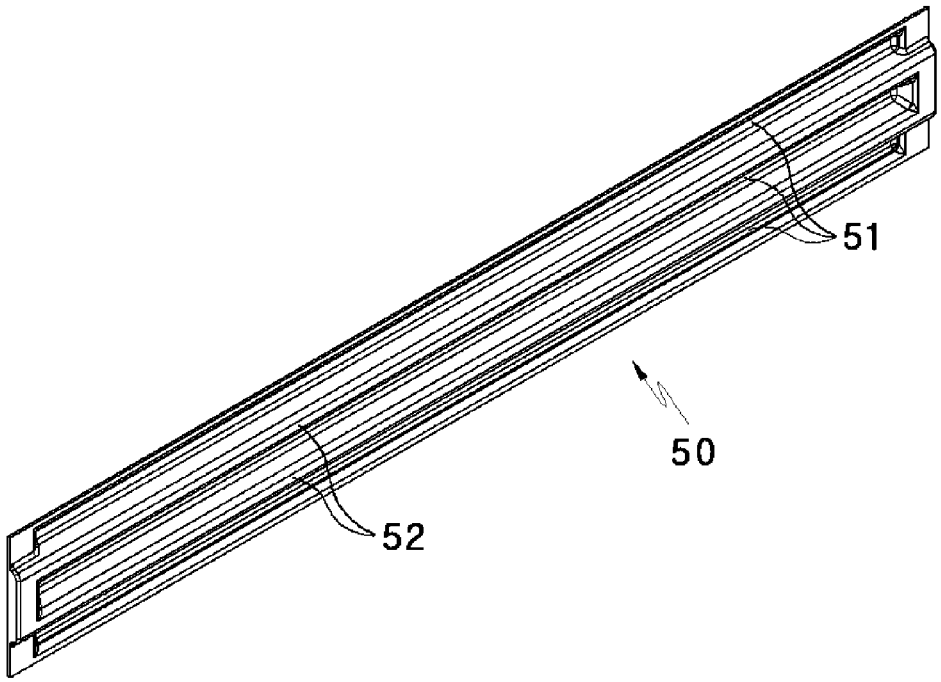
FIG. 8 is a view showing the shape of an insertion plate that is inserted in between the heat exchanging pipes according to an exemplary embodiment of the present invention.

FIG. 7A and FIG. 7B are views showing the shape of the first parallel flow channel cap 31 according to an exemplary embodiment of the present invention and FIG. 8 is a view showing an insertion plate 50 that is inserted in between the heat exchanging pipes 10 according to an exemplary embodiment of the present invention. The shape of the second parallel flow channel cap 32 is also substantially the same as that of the first parallel flow channel cap 31, except for the opening for connecting the heating water inlet 41 with the heating water outlet 42.

The first parallel flow channel cap 31 has a plurality of dome-shaped portions 31*a* for closing the ends of the heat exchanging pipe 10 and connecting portions 32*b* between the dome-shaped portions. In general, the parallel flow channel cap having the shape is manufactured by pressing. As described above, although the gaps between the heat exchanging pipes 10 in the boiler are only about 1 to 2 mm, it is very difficult to form the dome-shaped portions with 1 to 2 mm gaps by pressing (that is, it is very difficult to manufacture the first parallel flow channel cap 31 by pressing such that the connecting portions 31*b* are 1 to 2 mm long. In general, the minimum length of the connecting portions 32*b* where they can be formed by pressing is about 4 to 5 mm. When the heat exchange path is formed by the parallel flow channel cap, the gap between the heat exchanging pipes 10 close to the connecting portion of the parallel flow channel cap should be 4 to 5 mm and the gaps between the other heat exchanging pipes 10 are 1 to 2 mm, such that the gaps between the heat exchanging pipes 10 are not uniform. That is, the distance between the heat exchanging pipes 10 disposed around the dome-shaped portion 31 is 1 to 2 mm, while the distance between the heat exchanging pipes 10 adjacent to the connecting portion is 4 to 5 mm. In this case, most combustion gas flows through between the heat exchanging pipes 10 spaced at 4 to 5 mm for each other and does not uniformly pass through between the heat exchanging pipes 10, such that the heat exchange efficiency is reduced.

In order to remove this problem, the insertion plate 50 having a cross-sectional shape similar to the cross-sectional shape of the heat exchanging pipe 10 is inserted between the heat exchanging pipes 10 at the connecting portion 31*b* of the first parallel flow channel cap (see FIG. 4). The insertion plate 50 is formed by the alternate arrangement of protrusions 51 and recessions 52 as shown in FIGS. 4 and 8. An insertion plate 50 is also inserted at the connecting portion 32*b* of the second parallel flow channel cap 32 disposed alternately with the first parallel flow channel cap 31. As a result, the insertion plates 50 are inserted for every two heat exchanging pipes (see FIG. 3). Therefore, it is possible to maintain the gaps between the heat exchanging pipes 10 at about 1 to 2 mm regardless of the connecting portions 31*b* and the combustion gas can uniformly flow through between the whole heat exchanging pipes 10, thereby improving the heat exchange efficiency.

As described above, since the heat exchanging pipes 10 according to the exemplary embodiment of the present invention have the cross-sectional shape with the protrusion 11 and the recessions 12 alternately arranged in the width direction of the heat exchanging pipes, it is possible to allow the combustion gas to generate a turbulent flow along a longer flow path passing through the heat exchanging pipes, which increases the heat transfer efficiency. Further, each of the heat exchanging pipes 10 has the protrusions 13 spaced in the longitudinal direction 1 and the protrusions 13 of adjacent heat exchanging pipes are in contact with each other, such that it is possible to effectively prevent the heat exchanging pipes expanding due to the pressure of the heating water flowing through the heat exchanging pipes from blocking the flow path of the combustion gas. Further, since the insertion plates 50 having the shape similar to the cross-section of the heat exchanging pipes 10 are inserted at the positions corresponding to the connecting portions 31*b* of the parallel flow caps, it is possible to keep the whole gaps between the heat exchanging pipes 10 uniform and increase the heat exchange efficiency.

The present invention is not limited to the exemplary embodiments, also it will be apparent to those skilled in the art that various modification and changes may be made without departing from the scope and spirit of the present invention.

The invention claimed is:

1. A heat exchanger comprising:

a plurality of heat exchanging pipes, each of which is tube-type and has both ends open, and through the inside of each of which heating water passes;

a first fixing plate and a second fixing plate, each of which has pipe insertion holes spaced apart in the lengthwise direction of the plate, such that both ends of the plurality of heat exchanging pipes are inserted into the respective pipe insertion holes;

a first parallel flow channel cap and a second parallel flow channel cap fixed at the respective first fixing plate and second fixing plate to close both ends of the heat exchanging pipes and thus form a parallel flow channel, each of which having a plurality of dome-shaped portions and connecting portions connecting the dome-shaped portions;

a heating water inlet connected to the first parallel flow channel cap;

a heating water outlet connected to either the first or second parallel flow channel cap; and an insertion plate disposed between two adjacent pairs of heat exchanging pipes at a position corresponding to the connecting portion such that the two adjacent pairs of heat exchanging pipes are spaced apart, wherein each of the heat exchanging pipes has a plurality of first protrusions and a plurality of first recessions, the first recessions being depressed in the thickness direction of the heat exchanging pipe and also extending in the length direction of the heat exchange pipe, the first protrusions protruding in the thickness direction of the heat exchanging pipe and also extending in the length direction of the heat exchange pipe, and the first protrusions and the first recessions being alternately arranged in the width direction of the heat exchanging pipe so as to extend a flow path of combustion gas passing through between the heat exchanging pipes, wherein each of the heat exchanging pipes also has a plurality of second protrusions, the second protrusions protruding in the thickness direction of the heat exchanging pipe, also extending in the width direction of the heat exchange pipe and also being spaced apart in the length direction of the heat exchanging pipe, and the second protrusions facing each other of the heat exchanging pipes which are adjacent to form a pair being in contact with each other so that end surfaces of the second protrusions of the adjacent heat exchanging pipes are in contact in parallel with each other, thereby preventing the flow path of the combustion gas from being blocked by the expanding heat exchanging pipes, wherein end surfaces of the first protrusions of the heat exchanging pipe and end surfaces of the second protrusions of the heat exchanging pipe are connected to each other on a same plane, and wherein the insertion plate includes third protrusions extending in a lengthwise direction of the insertion plate and protruding towards the first recessions of the heat exchanging pipe while having a cross-sectional shape identical to a cross-sectional shape of the first recessions at a position facing the first recessions of the heat exchanging pipe that is facing one of two surfaces of the insertion plate, and second recessions depressed in an opposite direction to the protruding direction of the third protrusions while having a cross-sectional shape identical to a cross-sectional shape of the first protrusions at a position facing the first protrusions of the heat exchanging pipes that is facing one of the two surfaces of the insertion plate, in which the third protrusions and the second recessions are alternately arranged in the width direction of the insertion plates to extend the flow path of the combustion gas passing through between the heat exchanging pipes and the insertion plate.

2. The heat exchanger according to claim 1, wherein cross-sections of an upper portion and a lower portion of the heat exchanging pipe in the thickness direction have shapes matching with each other.

3. The heat exchanger according to claim 1, wherein the dome-shaped portions of the first parallel flow channel cap and the second parallel flow channel cap close the ends of the four heat exchanging pipes, and the plurality of dome-shaped portions in the first parallel flow channel cap and the plurality of dome-shaped portions in the second parallel flow channel cap are disposed by alternating with each other.

4. The heat exchanger according to claim 1, wherein a gap between the heat exchanging pipes forming a pair is 1 mm to 2 mm.

* * * * *